US006508177B1

(12) United States Patent
Badger et al.

(10) Patent No.: US 6,508,177 B1
(45) Date of Patent: Jan. 21, 2003

(54) EXPLOSIVES WITH EMBEDDED BODIES

(75) Inventors: Farrell G. Badger, Mapleton, UT (US); Lyman G. Bahr, Payson, UT (US)

(73) Assignee: The Ensign-Bickford Company, Simsbury, CT (US)

( * ) Notice: Subject to any disclaimer, the term of this patent is extended or adjusted under 35 U.S.C. 154(b) by 0 days.

(21) Appl. No.: 09/659,243

(22) Filed: Sep. 11, 2000

Related U.S. Application Data

(60) Provisional application No. 60/153,497, filed on Sep. 13, 1999.

(51) Int. Cl.[7] ..... C06D 5/06

(52) U.S. Cl. ..... 102/289; 102/288; 102/290; 102/318; 149/93

(58) Field of Search ..... 102/318, 286, 102/288, 289, 290; 149/93

(56) References Cited

U.S. PATENT DOCUMENTS

| | | | | | |
|---|---|---|---|---|---|
| 2,384,730 | A | * | 9/1945 | Davis et al. | 149/93 X |
| 2,407,805 | A | | 9/1946 | Wyler | 52/13 |
| 2,471,851 | A | * | 5/1949 | Wright et al. | 149/93 X |
| 2,482,091 | A | * | 9/1949 | Audrieth et al. | 149/93 X |
| 2,759,807 | A | * | 8/1956 | Kouba | 149/93 X |
| 3,371,606 | A | * | 3/1968 | Cook et al. | 102/318 |
| 3,377,955 | A | * | 4/1968 | Hodgson | 102/289 |
| 3,389,025 | A | * | 6/1968 | Nix et al. | 102/289 X |
| 3,466,204 | A | | 9/1969 | Gow | 149/3 |
| 3,580,754 | A | | 5/1971 | Barnhard, IV | 149/93 |
| 3,660,181 | A | | 5/1972 | Clay et al. | 149/2 |
| 3,702,272 | A | | 11/1972 | McDonnell | 149/19 |
| 3,706,278 | A | * | 12/1972 | Stiefel et al. | 102/288 X |
| 3,938,440 | A | * | 2/1976 | Dooley et al. | 102/288 X |
| 4,000,021 | A | | 12/1976 | Voigt, Jr. | 149/17 |
| 4,009,060 | A | | 2/1977 | Bluhm | 149/93 |
| 4,014,719 | A | * | 3/1977 | Wells | 149/93 X |
| 4,014,720 | A | | 3/1977 | Wells | 149/19.8 |
| 4,100,000 | A | | 7/1978 | Sterling et al. | 149/4 |
| 4,132,574 | A | | 1/1979 | Forrest | 149/2 |
| 4,331,081 | A | * | 5/1982 | Cloutier et al. | 102/286 X |
| 4,343,663 | A | * | 8/1982 | Breza et al. | 149/93 X |
| 4,627,352 | A | * | 12/1986 | Brachert et al. | 102/290 |
| 4,776,276 | A | | 10/1988 | Yunan | 102/275.5 |
| 4,952,254 | A | | 8/1990 | Betts et al. | 149/19.4 |
| 4,994,124 | A | | 2/1991 | Nguyen | 149/21 |
| 5,269,224 | A | * | 12/1993 | Gonzales et al. | 102/288 |
| 5,358,587 | A | | 10/1994 | Voigt, Jr. | 149/18 |
| 5,431,756 | A | | 7/1995 | Kosowski et al. | 149/18 |
| 5,650,589 | A | * | 7/1997 | Thiesen | 102/289 X |
| 5,682,009 | A | * | 10/1997 | O'Meara et al. | 102/290 |
| 5,996,501 | A | * | 12/1999 | Spencer | 102/286 |

FOREIGN PATENT DOCUMENTS

| | | | | |
|---|---|---|---|---|
| GB | 1442864 | * | 3/1974 | 102/286 |

* cited by examiner

*Primary Examiner*—Peter A. Nelson
(74) *Attorney, Agent, or Firm*—Libert & Associates; Frederick A. Spaeth

(57) ABSTRACT

An explosive charge such as a cast booster charge (10, 110, 210) includes an explosive charge (14, 114, 214) having a first explosive matrix material (114*a*, 214*a*) with discrete bodies (118, 218) of a second material embedded therein. In some embodiments, discrete bodies may comprise explosive material and the first explosive matrix material (114*a*, 214*a*) may be more sensitive to initiation than the explosive material of the discrete bodies (118, 218). In a separate aspect of the invention, the discrete bodies may have a minimum dimension of at least 1 millimeter or, optionally, 1.6 millimeter, regardless of the explosive properties of the material therein. In a particular embodiment, discrete bodies may be shaped as cylindrical pellets rounded at at least one end. The cast booster charge (10, 110, 210) may be produced by melting the first explosive, disposing discrete bodies therein and cooling the molten material to solid form.

17 Claims, 3 Drawing Sheets

FIG. 1
(PRIOR ART)
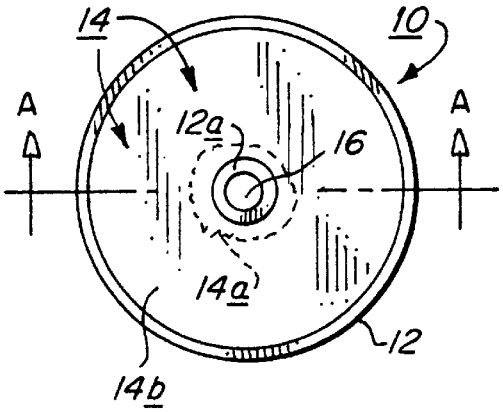
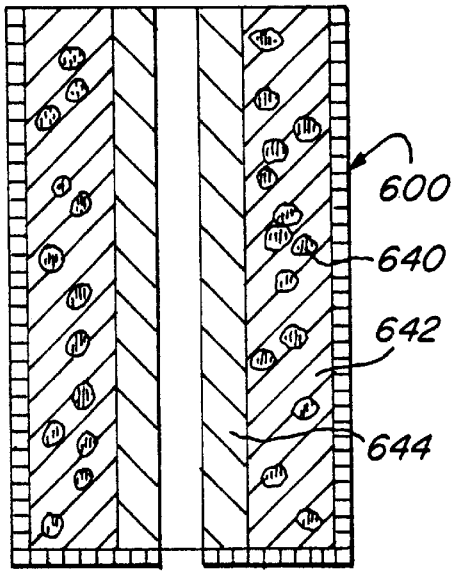
FIG. 1B
(PRIOR ART)
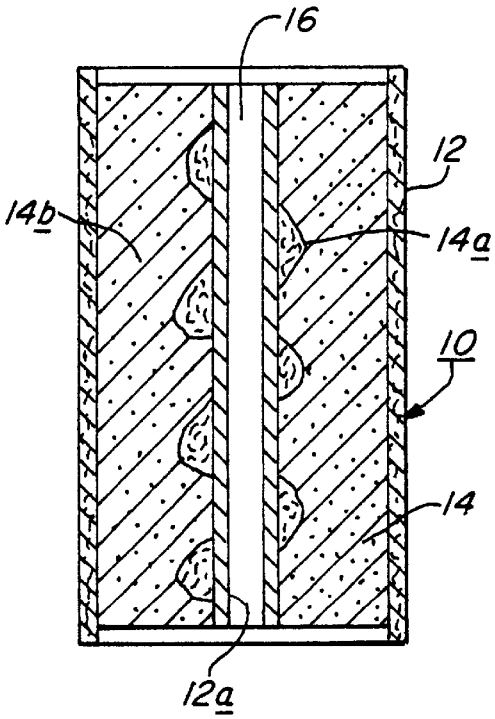
FIG. 1A
(PRIOR ART)
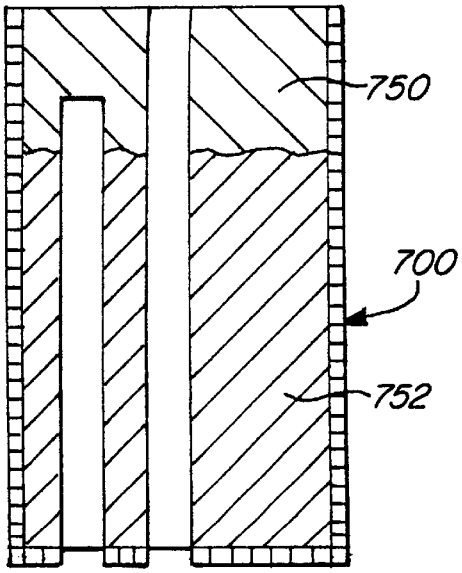
FIG. 1C
(PRIOR ART)

FIG. 2
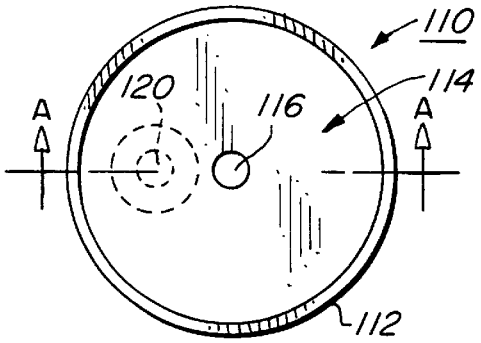
FIG. 3
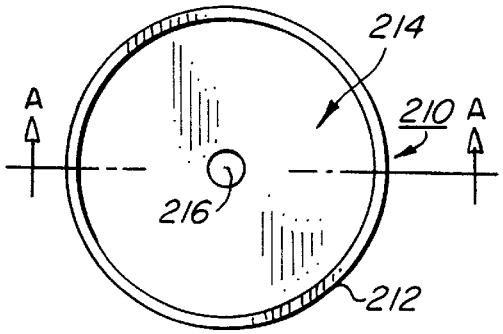
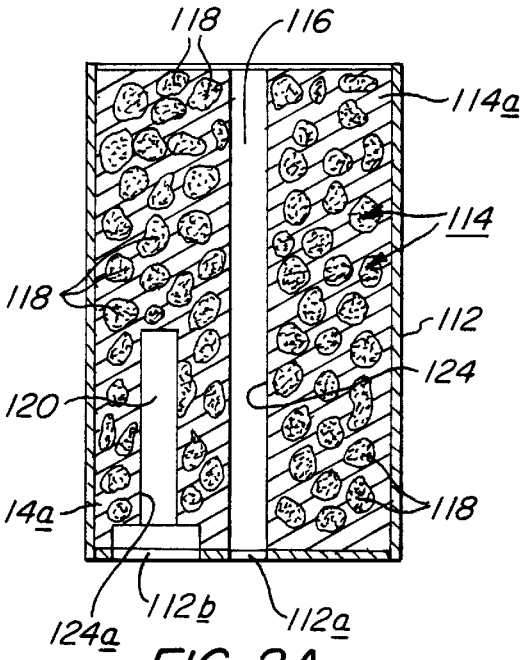
FIG. 2A
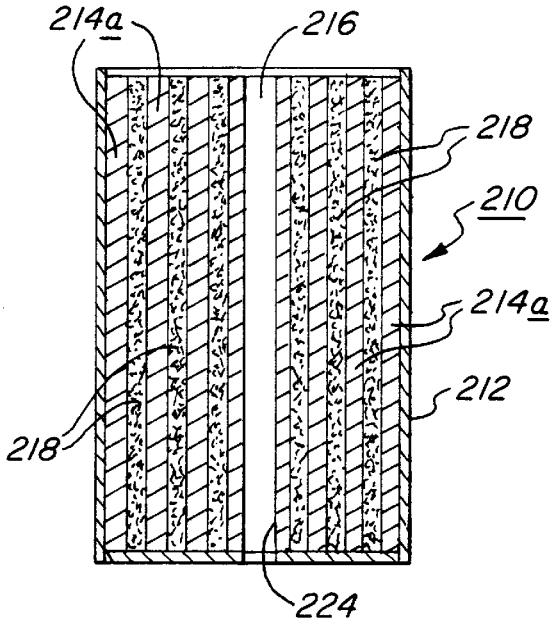
FIG. 3A
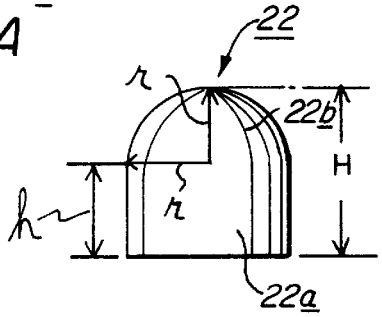
FIG. 4

EXPLOSIVES WITH EMBEDDED BODIES

CROSS-REFERENCE TO RELATED APPLICATION

This application claims the benefit of U.S. Provisional Application No. 60/153,497, filed on Sep. 13, 1999.

BACKGROUND OF THE INVENTION

1. Field of the Invention

The present invention is concerned with explosives comprising a continuous phase of a first explosive having embedded therein discrete bodies of a second explosive. More particularly, the present invention is concerned with cast explosives of the type commonly referred to as booster explosives.

2. Related Art

Booster charges are solid explosive charges used to initiate blasting agents such as ammonium nitrate-fuel oil (ANFO) mixtures. Such booster charges are available in a variety of sizes and shapes, e.g., cylindrical, conical, etc., typically having weights from, e.g., 5 grams to 88 ounces, lengths of 4 to 30 inches and diameters of 0.5 to 5 inches. Booster charges may be composed of trinitrotoluene (TNT), pentaerythritol tetranitrate (PETN), cyclo-trimethylene trinitramine (RDX), cyclotetramethylene tetranitramine (HMX), pentolite (a mixture of PETN and TNT), other types of explosives such as fuel-oxidizer mixtures, and various mixtures of these explosives. In addition, stabilizers, emulsifiers and other additives may be present in the explosive mixture of the booster charge. These explosives all have individual characteristics in terms of ease of initiation, explosive energy, brisance, shelf life, solidification point and other factors which impact safety and usage of the booster charges.

Booster charges are conventionally made by pouring into a container, which serves as a mold, a molten or otherwise pourable explosive material and solidifying it within the container. Solidification of the liquid explosive may be by means of cooling, polymerization, crystallization, chemical reaction, hydration, curing or other methods known in the art. The resulting charge may be of any suitable shape including cylindrical, conical, irregularly conical, spherical and polygonal. One cast booster charge representative of the prior art weighs about 12 ounces and may be about 4.7 inches long with a diameter 1.9 inches.

A suitable fixture may be placed within the container prior to pouring the pourable explosive therein to provide one or more initiator seats such as one or more bores (which may comprise passageways open at both ends or wells open at one end only) within the cast booster charge. An energetic initiation device or "initiator", such as a low-energy detonating cord (LEDC) and/or a detonator, is placed within the initiator seat so that upon initiation of the initiator, the cast booster charge is detonated. Cast booster charges are conventionally used to detonate a larger mass of a blasting agent such as the well known ammonium nitrate-fuel oil mixture ("ANFO").

As used herein, the term "contact surface" or "initiation surface" refers to a surface on the booster charge, optionally at an initiator seat (e.g., a bore, passageway, well, groove, indentation, etc.) configured to receive an initiator, which receives the initiation signal from the initiator.

The art has been concerned with, among other things, preparing cast booster charges of sufficient sensitivity so that they may be reliably initiated by low-energy initiators such as low-energy detonating cord and relatively low-energy or small detonators. For example, in a typical environment of use, one or more cast booster charges are placed within a borehole which is partially filled with ANFO. The borehole may also contain some stemming material such as crushed gravel to seal the top of the borehole and/or to divide the borehole into two or more stages or "decks" of ANFO. In any case, if the booster charges or detonators contained within the cast booster charges are to be initiated by detonating cord, the detonating cord must pass through the ANFO or other blasting agent. It is therefore desirable to use a low-energy detonating cord to avoid the possibility that detonation of the detonating cord will initiate the ANFO prematurely or alter its explosive properties prior to initiation of the cast booster charge.

FIGS. 1 and 1A (prior art) show a prior art expedient for increasing the sensitivity of a cast booster charge. To prepare charge 10, PETN 14*a* may be contained as a powder within a balloon which is wrapped around a straw 12*a* around which the main body (the continuous phase) of charge 10 is cast as an annular-shaped body 14*b* of a TNT-containing explosive such as pentolite or composition B (a mixture of RDX and TNT). In use, a low-energy detonating cord may be passed through passageway 16 as an initiator, and may be knotted below straw 12*a* in order to prevent its slipping out of passageway 16. The PETN therefore defines at least a portion of the initiation surface of charge 10. PETN is more sensitive than is the cast TNT-containing explosive, but it is also significantly more expensive. However, by providing PETN at the initiation surface, the reliability of initiation from the initiator is significantly improved. Upon initiation of the low-energy detonating cord (not shown) within passageway 16, the sensitive PETN 14*a* is detonated, which in turn detonates the less sensitive cast body 14*b*. Cast booster charge 10 is typically used to detonate a larger mass of a still less sensitive blasting agent such as ANFO, as is well known to those skilled in the art.

The prior art embodiment of FIGS. 1 and 1A has several drawbacks, including high production costs because of the necessity to fill balloons with the PETN and position and retain the balloon about the straw 12*a* and within a cylindrical container 12. Should the PETN balloon be omitted from one or more containers, the result would be a less sensitive, all TNT or TNT-based (or other explosive) cast booster charge which may not be sufficiently sensitive enough to be initiated by a low-energy detonating cord placed within passageway 16. The balloon may be misplaced, causing unreliable initiation. The invention eliminates this problem, and may incorporate the more sensitive explosives into a continuous phase to define the initiation surface. Optionally, the explosive material in the continuous phase may have a low permeability to water and so may not require isolation from water.

FIG. 1B is a cross-sectional view of another booster charge 600 according to the prior art. Cast booster charge 600 comprises TNT pellets 640, explosive filling 642 and a pentolite core 644. Pellet 640 and filling 642 are both composed of TNT only.

FIG. 1C is a cross-sectional view of still another prior art booster charge 700. Cast booster charge 700 comprises pentolite filling 750 and a less sensitive TNT-containing mixture for filling 752. There is no mixture of pentolite and TNT in this prior art charge. Note that if a detonator does not contact pentolite filling 750, sensitivity of the charge may not be sufficient to insure detonation.

It is further known in the art to make the booster explosive from a first explosive such as TNT and to contact or line the passageway with a second explosive which is more sensitive to initiation than the first explosive.

U.S. Pat. No. 4,776,276, issued to M. E. Yunan on Oct. 11, 1988 and entitled "Cast Explosive Primer Initiatable By Low-Energy Detonating Cord", discloses a cast booster charge which contains PETN disposed in a sleeve about the passageway through the charge where a detonating cord passes. The PETN about the passageway is more sensitive to initiation than the rest of the explosive material of the cast booster, so its close proximity to the detonating cord increases the reliability of initiation. Other prior art expedients include embedding a length of detonating cord at the passageway or providing a core of high PETN content surrounded by an annular body of a less sensitive explosive. The more sensitive, second explosive emplaced at the passageway is more reliably initiated by the detonating cord or detonator placed within the passageway and in turn initiates the remainder of the booster explosive.

U.S. Pat. No. 4,000,021, issued to Voigt, Jr. on Dec. 28, 1976 and entitled "Process For Suspending Particulate Additives In Molten TNT", discloses a process for suspending particulate additives in molten TNT. Composite explosive slurries are obtained by dispersing particulate solid components such as RDX in molten TNT in the presence of a water soluble gum, column 2, lines 10–16. The objective of the invention is to provide a process for dispersing particulate solids in molten TNT to allow production of cast explosive of uniform composition. Examples 1 and 4 reveal ammonium nitrate prills of particle size ranging from 150–1000 microns and examples 2–4 reveal use of RDX having an average particle size of 40 microns.

U.S. Pat. No. 2,384,730, issued to Davis et al on Sep. 11, 1945 and entitled "Method Of Preparing Cast Explosive Charges", discloses a thorough mixture of wet particulate PETN with molten TNT. The PETN is preferably relatively finely divided (column 2, lines 9–12) and thoroughly mixed with the TNT. The practice of adding dried PETN to molten TNT, with the resultant formation of lumps (presumably of PETN), is noted (column 1, lines 1–9).

A company called Canadian Industries Limited or "CIL" is believed to have manufactured a booster comprising a core of pentolite surrounded by prill and cast TNT on the outside.

It has been known in the manufacture of some military explosives to incorporate inert particulate material in order to increase the density of the explosive in the molten state. It is also known in the art to add solid particles of the molten material to control shrinkage and void formation in the cast body.

The prior art references do not disclose, either individually or in combination, an explosive comprising a plurality of larger discrete bodies (as opposed to powder particles (i.e., particles sized less than 1 mm)) of one explosive material or of an inert material, embedded within a continuous phase of another explosive material. These patents also do not disclose, individually or in combination, the mixture of discrete bodies of a less sensitive TNT-based mixture into a continuous phase of pentolite or the use of discrete bodies of materials comprising more than one explosive chemical compound.

SUMMARY OF THE INVENTION

The present invention provides an explosive charge comprising an explosive matrix material having therein a plurality of discrete bodies of a second material which is less sensitive to initiation than the matrix material.

In a particular embodiment, the matrix material may comprise a combination of PETN and TNT, and the second material may comprise TNT.

According to one aspect of the invention, the discrete bodies have a minimum dimension of at least 1 millimeter (mm), e.g., discrete bodies in the shape of pellets may have a diameter and length of at least 1 mm. In specific embodiments, the discrete bodies may be in the shape of round-ended cylinders having lengths and diameters of 0.8 centimeter (cm) or, optionally, 1.6 cm.

According to another aspect of the invention, the charge may define a contact surface for an initiator and the discrete bodies may be concentrated away from the contact surface to provide a region of high sensitivity near the contact surface.

According to still another aspect of the invention, the explosive charge may comprise a second plurality of discrete bodies of an explosive material.

The present invention also provides an explosive charge comprising an explosive matrix material having therein an interspersed phase comprising a plurality of discrete bodies of a second material, wherein the discrete bodies have a minimum dimension of at least 1 mm. Optionally, the second material may comprise an explosive material which is more sensitive to initiation than the material in the matrix material. For example, the matrix material may comprise TNT and wherein the second material may comprise pentolite. Alternatively, the discrete bodies may comprise an explosive material which is less sensitive to initiation than the matrix material, or they may comprise non-explosive material.

BRIEF DESCRIPTION OF THE DRAWINGS

FIG. 1 is a top plan view of a cast booster explosive in accordance with the prior art;

FIG. 1A is a longitudinal sectional view taken along line A—A of FIG. 1;

FIG. 1B is a cross-sectional view of a cast booster explosive in accordance with the prior art having a pentolite core;

FIG. 1C is a cross-sectional view of another cast booster explosive in accordance with the prior art having a pentolite layer and a TNT layer.

FIG. 2 is a top plan view of a cast booster explosive in accordance with one embodiment of the present invention;

FIG. 2A is a cross-sectional view taken along line A—A of FIG. 2;

FIG. 3 is a top plan view of a cast booster explosive in accordance with a second embodiment of the present invention;

FIG. 3A is a cross-sectional view taken along line A—A of FIG. 3;

FIG. 4 is an elevation view of a discrete body of a second explosive in accordance with another embodiment of the present invention;

DETAILED DESCRIPTION OF THE INVENTION AND PREFERRED EMBODIMENTS THEREOF

Figure 5:
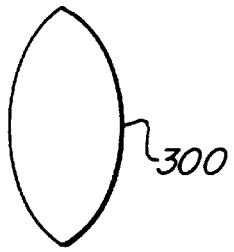
FIG. 5 is an elevation view of a discrete body of a second explosive in accordance with another embodiment of the present invention.

A first broad aspect of the present invention provides a cast charge having a solid matrix or body comprising an explosive material within which is disposed an interspersed phase of discrete bodies or regions of a second material which is less sensitive to initiation than the matrix material. In some embodiments, the interspersed phase comprises an explosive material which is less sensitive to initiation than the matrix material and in other embodiments, the material comprising the interspersed phase may comprise non-explosive material. In order to better ensure initiation from a low-energy initiator at a contact surface on the booster charge, the matrix may comprise, near the contact surface, a region in which the concentration of discrete bodies is lower than in other regions of the charge. Typically, the matrix is formed by pouring a quantity of a fluid, e.g., molten, explosive material into a mold. The molten material is allowed to solidify into a solid matrix about the discrete bodies therein, yielding a cast charge.

This aspect of the present invention differs from prior art cast booster charges having discrete bodies therein because, in the prior art, it is the discrete bodies which comprise the more sensitive explosive material. The invention arises from the realization that the matrix component of the charge can be chosen for its sensitivity rather than the discrete bodies therein and that a greater amount of the less sensitive material can then be used without sacrificing the overall sensitivity of the booster device. As a further result of the present invention, the initiation of the charge is less dependent upon proper distribution of the discrete bodies within the cast booster charge. Moreover, by adjusting the concentration and distribution of discrete bodies within the charge, a degree of control can be exercised over the velocity of detonation through the charge, particularly when the discrete bodies comprise non-explosive material. For example, a prior art booster designed to be initiated by 25 grain/foot PETN detonating cord may comprise an overall blend of 60% PETN and 40% TNT in the entire cast. When discrete bodies of TNT are employed in accordance with this invention, the same sensitivity can be achieved in a booster having an overall blend of 30% PETN and 70% TNT, by embedding discrete bodies of TNT within the cast continuous phase comprising the 60/40 PETN/TNT mixture.

According to a second broad aspect, the present invention provides a cast charge comprising a matrix of an explosive material and, in the matrix, discrete bodies which are macro-sized i.e., the smallest dimension may exceed the size of a powder particle (i.e., the smallest dimension of the discrete body is at least 1 mm), regardless of the explosive characteristics of the material therein. Optionally, the macro-sized bodies of the present invention may be inert, i.e., they may comprise an inert (i.e., non-explosive) material.

Optionally, the discrete bodies may be individually formed, e.g., they may comprise pressed or cast pellets of a predetermined shape, they may comprise encapsulated materials, etc. Typically, a discrete body in the present invention is not a single crystal, but it may comprise a plurality of crystals or an amorphous (non-crystalline) mass agglomerated together, e.g., as a pellet. The discrete bodies are sized and shaped so that they can be disposed in a mold and will define spaces between them into which a fluid matrix material can flow and solidify to create a monolithic charge which is a composite of the matrix material and the discrete bodies. Alternatively, they can be mixed into fluid, e.g., molten, matrix material and can be used to control the flow characteristics of the matrix material for the formation of the booster. In the case of molten matrix material, the discrete bodies accelerate the solidification of the matrix material and reduce shrinkage in the cast upon cooling by reducing the volume of molten material solidifying in the mold. The need for a second pour of molten material can thus be eliminated.

Various materials are known in the art for use in making cast charges and are suitable for use as the matrix material in an explosive charge in accordance with the present invention, including mixtures of PETN and TNT ("pentolite"), mixtures of TNT and other components such as aluminum (e.g., Tritonal), mixtures of PETN, TNT and other components, mixtures of PETN and TRITONAL, Composition B (mixtures of RDX (cyclonite), TNT and other components), Octol (mixtures of HMX and TNT), TNT/nitrate salt mixtures such as Amatol, castable or pourable plastic-bonded (PBX)-type compositions, RDX, HMX, fuel-oxidizer combinations in castable compositions and emulsion/slurry explosives. Non-explosive materials such as emulsifiers, natural petroleum products, waxes and oxidizers may also be employed in the composition as additives, fillers, etc. Any of these materials may be used in the matrix of the booster charge according to the present invention, as desired. In various embodiments, many of these materials might also be used in the interspersed phase, including those comprising combinations of explosive chemical compounds (e.g., pentolite) subject either to the restriction concerning decreased sensitivity of the interspersed phase relative to the matrix material or to the restrictions concerning the size or shape of the discrete bodies.

A result of at least the first aspect of the present invention is that it is not necessary to provide a core of high sensitivity material at the contact surface for the initiator within a surrounding body of less sensitive material, as shown, e.g., by U.S. Pat. No. 4,776,276 (discussed above). Referring now to FIGS. 2 and 2A, there is illustrated an embodiment of the present invention in which a cast booster 110 comprises an explosive charge 114 contained within a cylindrical container 112 having an aperture 112*a* formed in the bottom thereof, and a passageway 116 extending therethrough. The passageway 116 defines a contact surface 124 which may receive detonation energy from an initiator such as a detonating cord for initiation of the charge 114. Charge 114 comprises a solid matrix of a first explosive material 114*a* and discrete bodies 118, e.g., pellets or prills, of a second material interspersed in the matrix to provide the interspersed phase.

In addition to passageway 116 being formed within explosive charge 114, a detonator well 120 may be formed therein by placing within cylindrical container 112 a suitably shaped die (not shown) before pouring the molten explosive into container 112. A second aperture 112*b* is formed in the bottom of container 112 in order to receive the die used to make detonator well 120. The detonator well 120 defines a contact surface 124*a* which may receive detonation energy from an initiator such as a detonator (not shown) disposed within the well 120.

Since the contact surfaces of charge 114 are defined by the matrix material, the sensitivity of the explosive charge 114 can be modified by varying the composition of the matrix material and the composition of the embedded, interspersed discrete bodies. For example, the matrix material may be composed of a relatively sensitive material, e.g., pentolite, which may be easily detonated by a low energy initiator, e.g., low energy detonating cord. In such a case, the discrete bodies can be composed of a material which is less sensitive to initiation and less costly, since the sensitivity of the explosive charge to initiation is determined by the matrix material. The practice of the present invention therefore enable preparation of an explosive charge, such as a booster charge, in which the discrete bodies may comprise an explosive material which is less sensitive than that of the matrix material but which provides or contributes nonetheless to the overall output of the charge. This is the opposite arrangement from prior art devices in which the discrete bodies typically comprise an explosive material of greater sensitivity than the matrix material (which typically comprises TNT).

The less sensitive explosive material of the discrete bodies in the matrix material may comprise any of the castable materials discussed above or, optionally, even less sensitive materials. In order to form a discrete body these materials may optionally be molded or pressed into discrete volumes. To use an emulsion/slurry explosive in the discrete phase, the discrete bodies 118 may be in the form of capsules (not shown) containing a suitable explosive material. The second explosive material may comprise TNT, TRITONAL, PETN, perchlorate-based materials, propellant compositions containing nitrocellulose and nitrate esters. In a particular embodiment, the continuous phase may comprise pentolite and the discrete bodies may comprise TNT. Discrete bodies may also be provided in the form of prills, flakes, pellets, etc.

As will be appreciated, the pentolite first explosive (i.e., the matrix material) 114*a* is more sensitive to initiation by a low-energy detonating cord or other initiation means placed within passageway 116 than are the TNT discrete bodies 118. It will be noted that a low-energy detonating cord (not shown) or the like disposed within passageway 116 is contacted by or exposed to the matrix of pentolite 114*a* and, upon initiation of the low-energy detonating cord, the pentolite matrix 114*a* will be initiated and in turn will initiate the less sensitive discrete bodies 118 of TNT embedded within the pentolite matrix 114*a*.

A typical cast booster charge such as illustrated in FIG. 2 may be made, for example, with the body of pentolite matrix 11 4*a* comprising 60% by weight PETN and 40% by weight TNT, and with the discrete bodies 118 comprising 100% TNT. The resulting overall composition of explosive charge 114 of cast booster charge 110 would typically contain about 30% PETN and 70% TNT, but because the sensitivity of the device is determined by the continuous phase of pentolite matrix 114*a*, the device has the same sensitivity as would be attained by a conventional pentolite cast booster charge comprising a substantially homogeneous mixture of 60% PETN and 40% TNT. (Unless otherwise stated, all percents given herein are percents by weight.) Thus, this embodiment of the invention requires only about 30% PETN (balance, TNT), yet has the same sensitivity to initiation as a prior art homogeneous cast booster charge containing 60% PETN (balance, TNT). Analogous results can be attained with other combinations of sensitive matrix materials with less sensitive discrete bodies therein. In a presently preferred embodiment of the invention, the body of pentolite matrix 114*a* comprises 35% by weight PETN and 65% by weight TRITONAL; the discrete bodies 118 comprise 100% TNT or TRITONAL. Overall, the cast booster charge contains under 30% PETN.

An optional method of making explosive charges of the present invention is to disperse discrete bodies of a second explosive, such as the discrete bodies 118 of FIG. 2A, into a molten first explosive with mixing to distribute the discrete bodies substantially evenly throughout the molten first explosive and then solidifying the mixture, for example, by pouring the mixture into a suitable container such as container 112 of FIG. 2 and allowing the mixture to cool and solidify. Another option which is currently preferred for the 0.8 cm round-ended cylindrical pellets described above, is to pour molten explosive into the mold while the discrete bodies are simultaneously dispensed into the mold and then allowing the mixture to cool and solidify. Variations in the concentration of discrete bodies throughout the matrix can be achieved by varying the rate at which discrete bodies are dispersed into the mold relative to the rate at which the matrix material is dispersed. In this way, the discrete bodies may be concentrated at one end of the charge as the matrix material is being poured or in a particular stratum of the cast body. Yet another option, currently preferred for the rounded 1.6 cm pellets described herein, is to pour the pellets into the mold before adding the matrix material. The temperature of the molten first explosive matrix material may be lower than the melting temperature of the discrete bodies, or it may be higher provided the mixture is cooled before the discrete bodies fully melt and become dissolved into the matrix material. Partial melting of the discrete bodies is permissible, provided the solid cast charge still has discrete regions occupied exclusively by the material of the discrete bodies. The partial melting may improve the durability of the charge.

Any suitable method may be employed for the manufacture of the discrete bodies of the second explosive, such as discrete bodies 118. For example, discrete bodies 118 may be cast, accreted, press stamped or solidified in a prilling tower. In composition, discrete bodies 118 may be a single explosive, a mixture of more than one type of explosive, and may contain emulsifiers, stabilizers and other ingredients. Non-solid, e.g., liquid or gelatinous, materials may be used in encapsulated form.

It will be understood that a curing agent may be employed in the fluid matrix material for solidifying the matrix after dispersal of the discrete bodies of second explosive therein. A liquefied explosive may also be an explosive solution or a gelled explosive. Solidification may occur by means of cooling below the solidification temperature, or via the action of a curing agent, crystallization, chemical reaction or other methods.

In a separate aspect of this invention, the discrete bodies may comprise an explosive material which is more sensitive and/or which provides a more energetic output than the matrix material. For example, pentolite may be employed as the matrix material and Octol may be used for the discrete bodies which provide the interspersed phase. This combination provides a relatively high velocity of detonation (VOD) and detonation pressure approaching that of Octol while maintaining the desired sensitivity to initiation. When the discrete bodies comprise an explosive material which is more sensitive to initiation than the explosive matrix material, the discrete bodies may be concentrated near the contact surface of the charge to create a region of increased sensitivity near the initiator.

The matrix material may define the overall shape of the explosive charge. In particular, as discussed in more detail below, it may be desired to form a shaped charge for concentrating the explosive force in a particular direction. The discrete bodies of the second explosive may be any of a wide variety of configurations as described elsewhere herein.

One method of manufacturing cast booster charge 110 is to place within container 112 a rod-like die (not shown) to form passageway 116, the die also serving to define aperture 112*a*, and to place a second die (not shown) into container 112 to define detonator well 120 and aperture 112*b*. The container is then filled with discrete bodies which may be either irregular in shape as illustrated by discrete bodies 118 in FIG. 2A or which may be made of a regular configuration as described below in connection with FIG. 4. Such regularly configured discrete bodies are dimensioned and configured so that upon random dumping of the discrete bodies into the container 112 (FIG. 2A), interstices are formed between the discrete bodies to provide continuous interstitial flow paths throughout the resulting bed of discrete bodies within container 112. Irregularly shaped discrete bodies inherently have this property, and chips of explosive may advantageously be used. FIG. 5 illustrates a discrete body 300 of irregular, lemon-like shape. In any case, with discrete bodies 118 (FIG. 2A) in place within the container 112 and surrounding the die fixtures (not shown) which form passageway 116 and detonator well 120, molten pentolite or other suitable molten or liquid explosive is poured within container 112 to fill the interstitial flow paths formed between the discrete bodies 118. The molten pentolite is then allowed to cool and solidify to provide a solid matrix phase of pentolite 114*a* about the discrete bodies. The die which is used to form detonator well 120 is then removed via aperture 112*b* and the die used to form passageway 116 is removed via aperture 112*a* or via the open top of container 112. It will be understood that casting aids such as vacuum or vibration may also be utilized.

In use, a detonator of suitable size having a fuse connected thereto is inserted into detonator well 120 and the fuse threaded upwardly through passageway 116 for connection to a suitable means for initiating the fuse. The fuse may comprise a non-brisant impulse signal transmission fuse such as shock tube or deflagrating tube or an electric transmission wire for transmission to an electric detonator. Alternatively, or in addition, the fuse may be a brisant fuse such as a low-energy detonating cord which may initiate cast booster charge 110.

FIGS. 3 and 3A show another embodiment of the present invention wherein a cast booster charge 210 has an explosive charge 214 disposed within a container 212 and having a passageway 216 which is defined by a contact surface 224. A first explosive may comprise a body or matrix of pentolite 214*a* within which are embedded discrete bodies of a second explosive comprising rod-shaped bodies 218 of TNT. While not shown as such, the rod-shaped bodies 218 may be of non-uniform shape and/or rectangular shape. Rod-shaped bodies 218 may be emplaced within a mold or container 212 and a molten first explosive poured therearound to solidify and provide as a matrix material a suitably sensitive explosive such as a body of pentolite 214*a*. A grid-like fixture (not shown) may be employed to retain rod-shaped bodies 218 in upright, spaced-apart position while the molten first explosive is poured therearound. It will be appreciated that any suitably shaped discrete bodies of second explosive may be utilized, including rod-shaped bodies 218 as illustrated in FIG. 3 and 3A, irregularly discrete bodies 118 as illustrated in FIG. 2A, or regularly shaped spheres, pellets, prills or the like, or more complex shapes as illustrated in FIG. 4.

The discrete bodies of second explosive should have shapes, sizes and positions in the mold which permit the fluid matrix material to flow between them, and it will be understood that a wide variety of sizes and configurations will serve this purpose. FIG. 4 illustrates one embodiment of such discrete bodies which are easier to manufacture than spheres and essentially comprise round-ended cylinders, i.e., cylindrical bodies having a hemispherical-shaped or rounded end. Thus, discrete body 22 comprises a cylindrical-shaped stem portion 22*a* which is of circular cross-section, a flat round end and a hemispherical end portion 22*b*. One useful design of such a pellet provides that the height h of the cylindrical stem portion 22*a* is substantially the same as the radius r of the hemispherical end portion 22*b*, so that the overall height H (i.e., the length of the body), r plus h, equals the diameter of a sphere of the same radius. Optionally, the diameter of the cylinder may be at least 1 mm. In one construction which has been found useful for conventionally sized cast booster charges, H equals 1.6 centimeters ("cm") and r equals 0.8 cm. Thus, the pellet is configured as a round-ended cylinder and has a length and diameter of 1.6 cm. Pellets of this size weigh roughly 4–5 grams, however, weight of the pellets will vary with composition, size and shape of the pellets. In other embodiments, similarly configured pellets having a length and diameter of 0.8 cm were found to be useful.

The size of the discrete bodies may affect the manufacturing processes for the booster and the load percentage of the discrete bodies and thus the overall composition of the cast booster charge. For example, the size of the bodies may affect the ability of the first explosive to form a matrix throughout the remaining volume of the explosive charge. Discrete bodies which are excessively small may cause undesirable viscous effects which impair even distribution of the first explosive in a matrix material throughout the body of the explosive charge. In a particular embodiment with a matrix material containing about 60% PETN and about 40% TNT, the smallest geometric dimension of the discrete bodies (e.g., length, width, height, thickness, diameter, etc.) may be at least about 0.1 cm, and the discrete bodies may optionally be sized from about 0.1 cm up to about 2 cm, including any dimension between those values. The maximum size of the discrete bodies is set by practical considerations including the size of the explosive charge, e.g., the cast booster charge, of which the discrete bodies form a part. However, it will be appreciated that various sizes of the discrete bodies may be employed in the practice of this invention and this range is intended as exemplary only and thus may be exceeded within the scope of the present invention. The use of larger discrete bodies than have been used in the prior art provides the benefit of reducing or eliminating voids between the matrix phase and the interspersed phase and so reduces the need for special void-reducing techniques which have been used for producing prior art boosters.

Another factor in creating a dual-phase charge relates to the respective melting temperatures of the materials in the matrix phase and in the discrete bodies. The first explosive may, as indicated above, comprise pentolite, which comprises 20 to 65 percent by weight PETN, balance TNT. Pentolite and TNT form a eutectic mixture which solidifies at 76.1° C. If the melting point of the discrete bodies is higher than the melting point of the explosive material of the matrix phase, the discrete bodies can be immersed in the molten matrix material and there will be no melting of the surface of the discrete bodies. If the matrix material is heated to a temperature sufficient to partially melt the discrete bodies, the discrete bodies will partially diffuse into the continuous phase. Then, instead of a sharp boundary between them, there will be a gradual change in composition from one phase into the other. Such melting may improve the physical durability of the composition.

Figure 6:
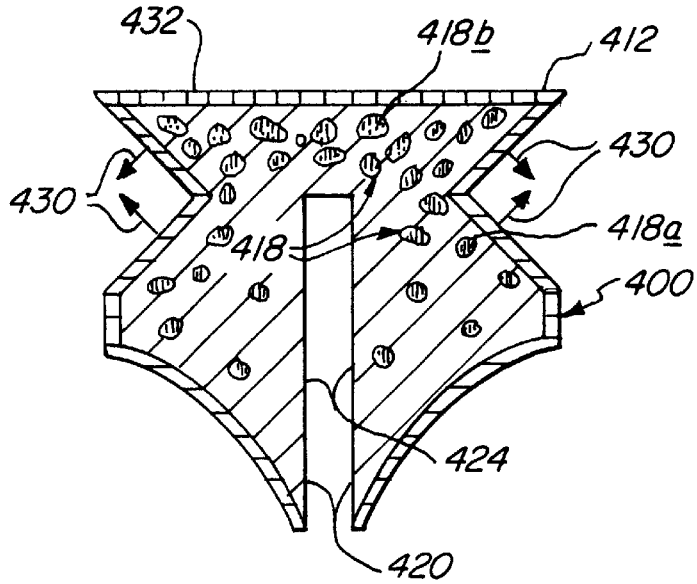
FIG. 6 is a cross-sectional view of a booster charge in accordance with another embodiment of the present invention.

FIG. 6 is a cross-sectional view of a cast booster charge according to another embodiment of the invention, shown generally at 400, in which detonator well 420 is provided for receiving an initiator device such as a detonator (not shown) and is defined by a contact surface 424. In this embodiment, a non-uniform distribution of discrete bodies 418 is employed within a container 412 to concentrate the discrete bodies away from contact surface 424. The container 412 is arranged in the form of a shaped charge for concentrating an explosive force in the direction of arrows 430. In order to further increase the explosive force along arrows 430 the concentration of discrete bodies 418 is increased adjacent a portion 432 of the container 412. It will also be understood that the composition of various discrete bodies 418 may be varied in order to increase or decrease the explosive force along arrows 430. For example, a discrete body 418*a* may include a composition of, e.g., TNT or pentolite whereas a discrete body 418*b* may be composed of, e.g., RDX or HMX or mixture thereof.

Figure 7:
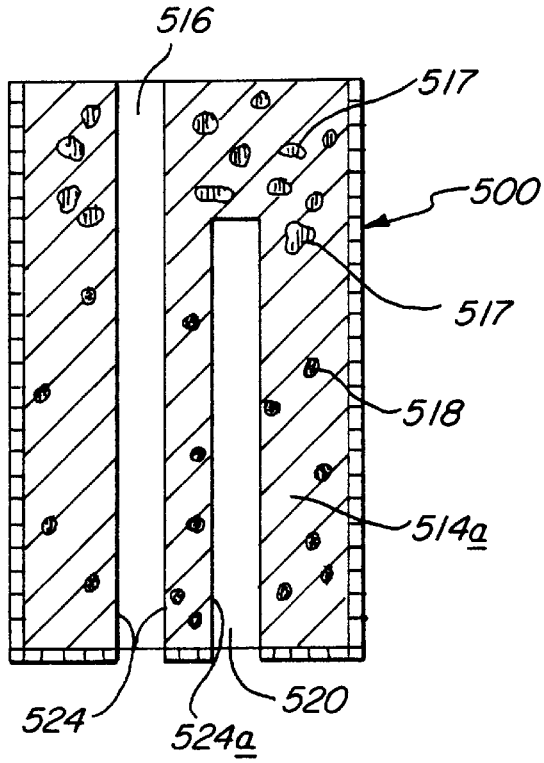
FIG. 7 is a cross-sectional view of a cast booster explosive in accordance with another embodiment of the present invention.

FIG. 7 is a cross-sectional view of another embodiment of a cast booster charge which is illustrated generally at 500. In this embodiment, in addition to passageway 516 the cast booster charge 500 comprises a detonator well 520. Discrete bodies 517 may be, e.g., of a first composition comprising 10% PETN and 90% TNT by weight. Second discrete bodies 518 may be, e.g., of a second composition comprising 100% TNT. Matrix phase 514*a* may be composed of a mixture comprising 60% PETN and 40% TNT. This arrangement of discrete bodies 517 and 518 of various compositions will provide a varying explosive effect depending on the location of the discrete bodies within the cast booster charges 500. Also, as discussed above, the performance of the charge may be enhanced by providing discrete bodies which, while having a low sensitivity, have a high brisance. Contact surfaces 524, 524*a* are provided for receiving detonation energy discussed above.

While the invention has been described in detail with respect to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. An explosive charge comprising:

a continuous phase comprising a first explosive matrix material having therein a plurality of discrete bodies of a second material which is less sensitive to initiation than the continuous phase, the discrete bodies having a minimum dimension of at least 1 mm, where in the matrix material defines a contact surface for an initiator and wherein the discrete bodies are concentrated away from the contact surface to provide a region of high sensitivity near the contact surface.

2. The explosive charge of claim 1, wherein the matrix material comprises a combination of PETN and TNT.

3. The explosive charge of claim 1 or claim 2 further comprising a second plurality of discrete bodies comprising an explosive material.

4. The explosive charge of claim 1 or claim 2 wherein the discrete bodies comprise pellets having lengths and diameters of 0.8 cm.

5. The explosive charge of claim 1 or claim 2 wherein the discrete bodies comprise pellets having a minimum dimension of 1.6 cm.

6. The explosive charge of claim 1 or claim 2 wherein the second material comprises TNT.

7. The explosive charge of claim 1 wherein the discrete bodies comprise a non-explosive material.

8. The explosive charge of claim 1 wherein the contact surface comprises a cylindrical contact surface.

9. An explosive charge comprising:

a first explosive matrix material having therein an interspersed phase comprising a plurality of discrete bodies of a second material which is more sensitive to initiation than the matrix material, wherein the discrete bodies have a minimum dimension of at least 1 mm, and wherein the charge defines a contact surface for an initiator, wherein the discrete bodies are concentrated near the contact surface to provide a region of high sensitivity near the contact surface.

10. The explosive charge of claim 9 or claim 7 wherein the discrete bodies further comprise pellets having a minimum dimension of 1.6 cm.

11. The explosive charge of claim 9 or claim 7 comprising discrete bodies in the shape of round-ended cylinders having a diameter of at least 1.6 cm.

12. The explosive charge of claim 7 wherein the matrix material defines a contact surface for.an initiator and wherein the discrete bodies are concentrated away from the contact surface to provide a region of high sensitivity near the contact surface.

13. The explosive charge of claim 12 wherein the matrix material comprises pentolite.

14. The explosive charge of claim 1, claim 2 or claim 9 wherein the discrete bodies comprise round-ended cylindrical pellets.

15. The explosive charge of claim 14 wherein the discrete bodies have a length of about 1.6 centimeters.

16. The explosive charge of claim 14 wherein the discrete bodies comprise TNT.

17. The explosive charge of claim 12 wherein the contact surface comprises a cylindrical contact surface.

* * * * *

UNITED STATES PATENT AND TRADEMARK OFFICE

CERTIFICATE OF CORRECTION

PATENT NO. : 6,508,177 B1
DATED : January 21, 2003
INVENTOR(S) : Badger et al.

It is certified that error appears in the above-identified patent and that said Letters Patent is hereby corrected as shown below:

Drawings,
Fig. 2A, replace “14a” with -- 114a --

Column 1,
Line 46, after “diameter” insert therefor -- of about --

Column 2,
Line 21, delete “14b” and insert therefor -- 14 --
Line 22, after “explosive” insert therefor -- 14b --

Column 7,
Line 5, delete “enable” and insert therefor -- enables --
Line 39, delete “Figure 2” and insert therefor -- Figures 2 and 2A --
Line 41, delete “11 4a” and insert therefor -- 114a --

Signed and Sealed this

Twenty-second Day of June, 2004

JON W. DUDAS
*Acting Director of the United States Patent and Trademark Office*